United States Patent [19]

Axinger

[11] Patent Number: 5,063,849

[45] Date of Patent: Nov. 12, 1991

[54] SUBWARHEAD

[75] Inventor: Jan Axinger, Storfors, Sweden

[73] Assignee: Aktiebolaget Bofors, Bofors, Sweden

[21] Appl. No.: 599,851

[22] Filed: Oct. 19, 1990

[30] Foreign Application Priority Data

Oct. 20, 1989 [SE] Sweden ..... 8903473

[51] Int. Cl.[5] ..... F42B 10/50

[52] U.S. Cl. ..... 102/388; 102/393; 102/476; 102/489; 244/3.24

[58] Field of Search ..... 102/384, 386, 388, 393, 102/489, 476; 244/321, 324, 3.26–3.29

[56] References Cited

U.S. PATENT DOCUMENTS

| | | | |
|---|---|---|---|
| 2,924,175 | 2/1960 | Jasse . | |
| 3,643,599 | 2/1972 | Hubich | 244/3.27 |
| 4,667,899 | 5/1987 | Wedertz | 244/3.27 |
| 4,715,282 | 12/1987 | Rosenberg et al. | 102/393 |
| 4,858,532 | 8/1989 | Persson et al. | 102/476 |

FOREIGN PATENT DOCUMENTS

| | | | |
|---|---|---|---|
| 176045 | 4/1986 | European Pat. Off. | 102/476 |

*Primary Examiner*—Harold J. Tudor

*Attorney, Agent, or Firm*—Pollock, Vande Sande & Priddy

[57] ABSTRACT

A subwarhead which is adapted to be separated from a missile over a target area comprises an active part, a target detector and an aerofoil, the target detector and the aerofoil being pivotably mounted each on its own bearing shaft parallel with the line of symmetry of the active part in order to allow pivoting out of the target detector and of the aerofoil from a folded position to an unfolded position at the side of the active part in order to allow a controlled movement of scanning of the target area. Both the target detector and the aerofoil are provided with one or more displaceably arranged additional aerofoils for the purpose of increasing the braking area of the subwarhead in order to reduce the descent rate.

2 Claims, 2 Drawing Sheets

SUBWARHEAD

FIELD OF THE INVENTION

The present invention relates to a subwarhead arranged to be separated from a missile, for example a carrier shell or the like, over a target area, the subwarhead comprising an active part, a target detector and means for imparting a rotation to the subwarhead for scanning of the target area in a helical pattern during the descent of the subwarhead towards the target area.

BACKGROUND OF THE INVENTION

A subwarhead of the above type has been in the Swedish patent 86 01423-0.

In accordance with the characteristic features of the subwarhead described in the above patent the target detector is arranged pivotably on a bearing shaft which is parallel with the line of symmetry of the active part in order to allow pivoting out of the target detector from a folded position, in which the optical axis of the target detector coincides with the line of symmetry of the active part, to a folded position, in which the optical axis of the target detector is parallel with the line of symmetry of the active part, in order to allow a free view of the target detector at the side of the active part. Furthermore an aerofoil is pivotably arranged on a bearing shaft which is also parallel with the line of symmetry of the active part in order to allow pivoting out of the aerofoil from a folded position to a folded position at the side of the active part.

By means of an expedient aerodynamic design of the subwarhead and the braking area of the detector and the aerofoil, a suitable rate of descent of the subwarhead and furthermore a driving moment, which imparts to the subwarhead its rotation, around the axis of spin are obtained. This is brought about without assistance from a parachute, which is an advantage since the parachute takes up space. Within the available space in a carrier shell, an increased space can instead be made available for the active part itself.

Although the subwarhead described above has proved to have good characteristics as far as rate of descent and scanning rotation are concerned, it has become desirable to be able to further increase the braking area. This can be the case, for example, when it is desired to use heavier active parts. The braking area of the target detector and aerofoil is limited to the cross-sectional area of the cylindrical subwarhead, which can result in the rate of descent becoming too high with the existing size of the braking area if the weight of the active part is increased at the same time.

SUMMARY OF THE INVENTION

The main purpose of this invention is to produce a subwarhead of the abovementioned type but with a substantially greater braking area. According to the present invention this is achieved in a simple manner and without having to use extra space.

The invention is described below in greater detail with reference to the attached drawings in which:

DETAILED DESCRIPTION OF THE PREFERRED EMBODIMENT(S)

Figure 1A:
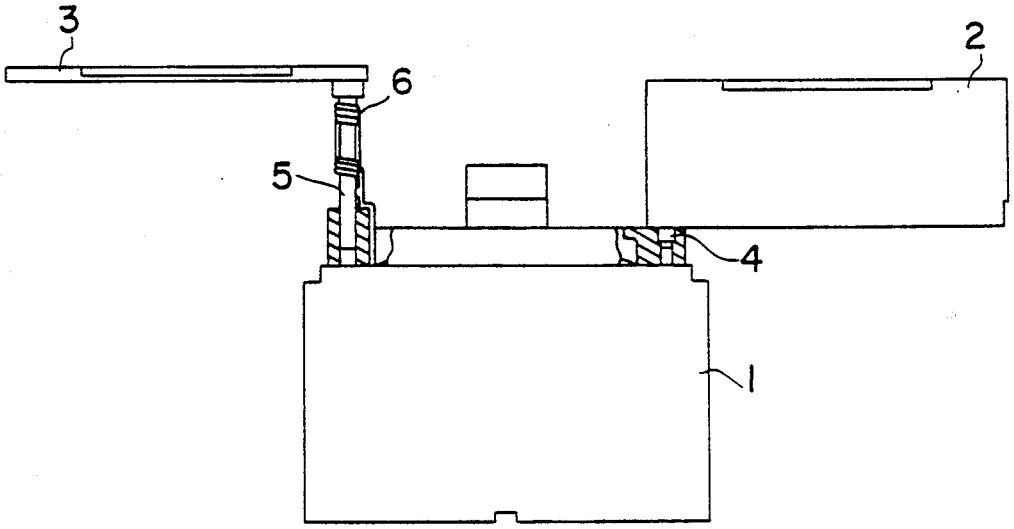
FIG. 1 shows a first embodiment of the subwarhead according to the present invention, both from the side (FIG. 1*a*) and from above (FIG. 1*b*)

In FIG. 1, a subwarhead 1 is shown, which has been separated from a carrier shell. The carrier shell can be one of 15.5 cm caliber, for example, which is fired from a field artillery piece in a conventional manner in a ballistic trajectory towards a target area. In order to give the subwarhead a controlled movement of scanning of the target area, that is to say a controlled rotation and rate of descent, a target detector 2 and an aerofoil 3 are each pivotably arranged on their own folding-out shaft 4 and 5. In the figures, the subwarhead is shown in its pivoted-out position, that is the position which the subwarhead assumes after it has been separated from the canister. Both the detector 2 and the aerofoil 3 are rotated by 180° about their respective bearing shafts, preferably with the aid of torsion springs, one torsion spring 6 for the arofoil 3 having been indicated in the figures. The subwarhead furthermore includes a shaped charge which forms a projectile and is not described further here. The missile thus formed is dimensioned such that desirable flight-mechanical characteristics are obtained, in which connection reference is made to the Swedish patent 86 01423-0 mentioned in the introduction.

Figure 1B:
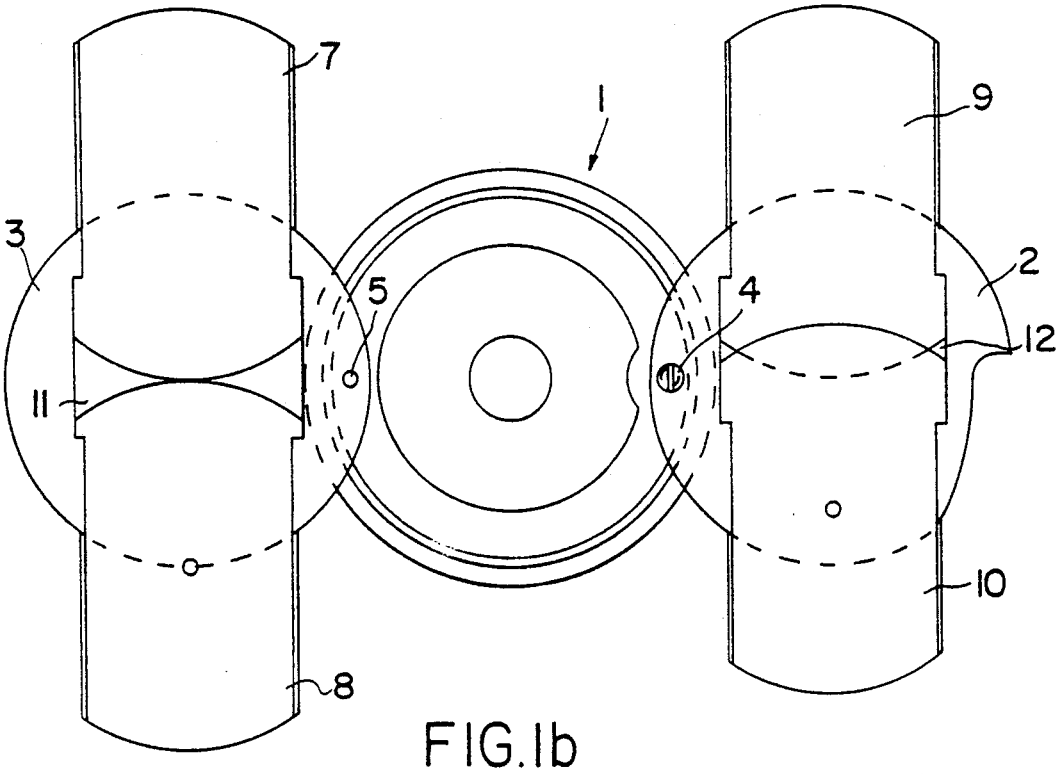

Both the target detector 2 and the aerofoil 3 consist of a circular base part which in its pivoted-in position forms a top part and cover for the subwarhead, and in this base part one or more movably arranged additional aerofoils 7, 8, 9 and 10 are provided. The aerofoils are preferably arranged in slots 11, 12 in the top part of the base part and are driven by centrifugal force from a folded position, in which the additional aerofoils overlap one another, to their unfolded positions which are shown in FIG. 1*b*. In FIG. 1*b*, the additional aerofoils are arranged to move outwards in diametrically opposite directions within each pair.

Figure 2A:
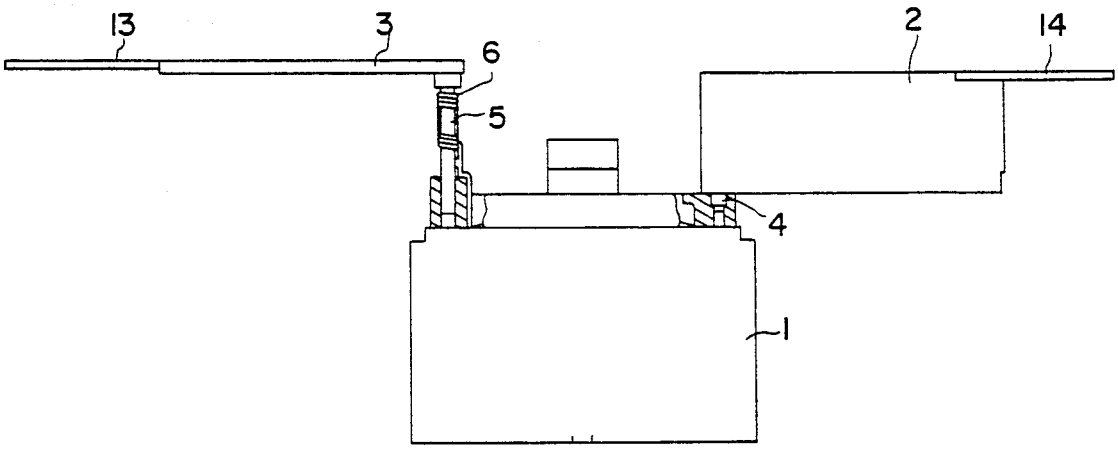
FIG. 2 shows a second embodiment of the present invention subwarhead.
Figure 2B:
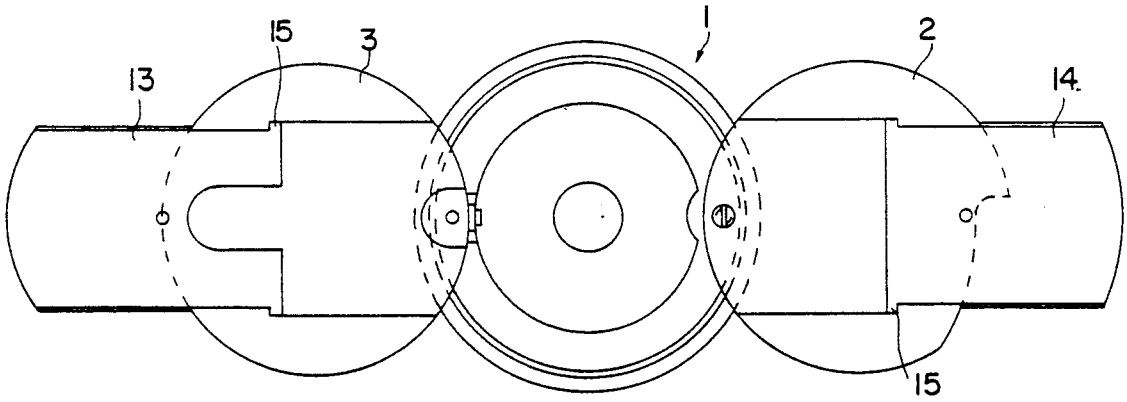

In FIG. 2, an embodiment is shown in which the target detector and the aerofoil each bear only one additional aerofoil 13, 14, which aerofoils are driven outwards by the centrifugal force in diametrically opposite directions into a fixed unfolded position in which a shoulder or the like 15 prevents further movement.

By virtue of the additional aerofoils, the braking area of both the target detector and the aerofoil can be increased substantially and thus allow a controlled scanning movement even for heavier active parts.

I claim:

1. A subwarhead adapted to be separated from a missile over a target area, said subwarhead comprising:

an active part, a target detector and an aerofoil, the target detector and the aerofoil being pivotably mounted each on its own bearing shaft, parallel with the line of symmetry of the active part, for allowing pivoting out of the target detector and the aerofoil from a folded position to an unfolded position at the side of the active part in order to allow a controlled movement of scanning of the target area, both the target detector and the aerofoil being provided with at least one displaceably mounted means for increasing the braking area for controlling the rate of descent of the subwarhead; said at least one displaceably mounted means being an additional aerofoil arranged to be displaceable in a slot provided in the target detector and in the aerofoil, respectively.

2. A subwarhead adapted to be separated from a missile over a target area, said subwarhead comprising:

an active part, a target detector and an aerofoil, the target detector and the aerofoil being pivotably mounted each on its own bearing shaft parallel with the line or symmetry of the active part in order to allow pivoting out of the target detector and the aerofoil from a folded position to a unfolded position at the side of the active part in order to allow a controlled movement of scanning of the target area, both the target detector and the aerofoil being provided with a pair of additional aerofoils, each pair being displaceable from a folded overlapping position to an unfolded position in a slot provided in the target detector and in the aerofoil, respectively.

* * * * *